US007900365B1

(12) United States Patent
Johnson

(10) Patent No.: US 7,900,365 B1
(45) Date of Patent: Mar. 8, 2011

(54) ARCHERY SIGHT ASSEMBLY

(76) Inventor: Steven C. Johnson, Harrisburg, OR (US)

( * ) Notice: Subject to any disclaimer, the term of this patent is extended or adjusted under 35 U.S.C. 154(b) by 0 days.

(21) Appl. No.: 12/571,306

(22) Filed: Sep. 30, 2009

(51) Int. Cl.
*F41G 1/467* (2006.01)

(52) U.S. Cl. ..... 33/265

(58) Field of Classification Search ..... 33/265; 124/87

See application file for complete search history.

(56) References Cited

U.S. PATENT DOCUMENTS

| | | | | | |
|---|---|---|---|---|---|
| 2,545,454 | A * | 3/1951 | Fredrickson | 33/265 |
| 3,355,809 | A * | 12/1967 | Guyton | 33/265 |
| 5,117,804 | A * | 6/1992 | Jorlov | 124/87 |
| 5,228,204 | A * | 7/1993 | Khoshnood | 33/265 |
| 5,289,814 | A * | 3/1994 | Maisano | 124/87 |
| 5,414,936 | A * | 5/1995 | Sappington | 33/265 |
| 5,507,272 | A * | 4/1996 | Scantlen | 124/87 |
| 5,524,351 | A * | 6/1996 | Pinson et al. | 33/265 |
| 5,718,215 | A * | 2/1998 | Kenny et al. | 124/87 |
| 5,722,175 | A * | 3/1998 | Slates | 33/265 |
| 6,802,129 | B1 * | 10/2004 | Wirth | 33/265 |
| 7,610,686 | B1 * | 11/2009 | Summers et al. | 33/265 |
| 2005/0183272 | A1 * | 8/2005 | Meadows | 33/265 |

* cited by examiner

*Primary Examiner* — Christopher W Fulton
(74) *Attorney, Agent, or Firm* — David S. Alavi

(57) ABSTRACT

An archery sight assembly comprises a sight, a mounting bracket, and a positioning mechanism for providing adjustment of relative positions or orientations of sight and bracket, which can include a transverse position relative to a sighting direction defined by the sight. The positioning mechanism can include a linear bearing with cylindrical bearing members, a scale and a pointer adjustable relative to the scale, or a rack coupled by one or more gears to an adjustment knob. A method for making the archery sight assembly comprises coupling the archery sight to the mounting bracket using the positioning mechanism. A method for using the archery sight assembly comprises adjusting the position or orientation of the archery sight relative to the mounting bracket using the positioning mechanism.

23 Claims, 13 Drawing Sheets

ARCHERY SIGHT ASSEMBLY

BACKGROUND

The field of the present invention relates to archery sights. In particular, an archery sight assembly is disclosed herein that includes a linear bearing, an adjustable pointer, or a rack coupled by one or more gears to an adjustment knob.

A wide variety of archery sights have been developed previously. Ideally, in most archery sights a pin, reticle, crosshair, or other reference marker is positioned relative to the bow so that when lined up on a target object at a given distance (i.e., when the archer holding the drawn bow looks through the sight with the reference marker on the target object), an arrow shot by the bow will hit the target object. To achieve that goal requires precise adjustment of the position and orientation of the sight with respect to the bow. In addition, to accurately aim at objects at other distances or to account for crosswinds requires known, repeatable adjustments of the sight. To that end, a typical archery sight includes an adjustable positioning mechanism coupling the sight to the bow, and the positioning mechanism often includes some sort of scale for indicating the position of the sight (equivalently, the target position that results from aiming with the sight).

SUMMARY

An archery sight assembly comprises an archery sight, a mounting bracket, and a positioning mechanism. The archery sight defines a longitudinal sighting direction. The mounting bracket is arranged to be substantially rigidly attached to an archery bow. The positioning mechanism couples the archery sight to the mounting bracket and is arranged to provide adjustment of the position or orientation of the archery sight relative to the mounting bracket. The archery sight assembly can be mounted on an archery bow by substantially rigidly attaching the mounting bracket to the bow.

In one embodiment of an archery sight assembly, the positioning mechanism includes at least one linear bearing for providing substantially linear motion of the archery sight along a corresponding direction substantially transverse to the sighting direction. The linear bearing comprises a bearing track, a bearing slide, and a pair of cylindrical bearing members. The bearing track has along at least a portion of its length a U-shaped cross-section transverse to a direction of motion defined by the linear bearing. Each of two side portions of the U-shaped cross section of the bearing track has a corresponding groove on its inner surface arranged substantially parallel to the defined direction of motion. The grooves of the corresponding side portions face one another across the bearing track. The bearing slide is positioned between the side portions of the bearing track and reciprocally moveable within the bearing track along the defined direction of motion. The bearing slide has a groove on each of two opposite sides, each arranged substantially parallel to the defined direction of motion and facing a corresponding one of the bearing track grooves. Each cylindrical bearing member is positioned with its corresponding cylinder axis substantially parallel to the defined direction of motion and is engaged with corresponding facing bearing track and bearing slide grooves. Each cylindrical bearing is arranged to slide along at least one of the corresponding engaged grooves as the bearing slide moves along the defined direction within the bearing track.

In another embodiment of an archery sight assembly, the positioning mechanism includes (i) a scale arranged to indicate motion along or about a corresponding direction or axis of motion and (ii) a pointer arranged so that the scale moves relative to the pointer during the indicated motion. The pointer includes an adjustment mechanism that enables it to be repositioned relative to the scale and a locking mechanism that enables it to be released and repositioned by the adjustment mechanism and to be retained at a desired position relative to the scale.

In another embodiment of an archery sight assembly, the positioning mechanism comprises a rack, an adjustment knob, and one or more gears coupling the rack to the adjustment knob. The rack provides substantially linear motion of the archery sight along a corresponding direction substantially transverse to the sighting direction.

A method for making the archery sight assembly comprises coupling the archery sight to the mounting bracket using the positioning mechanism. A method for using the archery sight assembly comprises adjusting the position or orientation of the archery sight relative to the mounting bracket using the positioning mechanism.

Objects and advantages pertaining to archery sights may become apparent upon referring to the exemplary embodiments illustrated in the drawings and disclosed in the following written description or appended claims.

Figure 1:
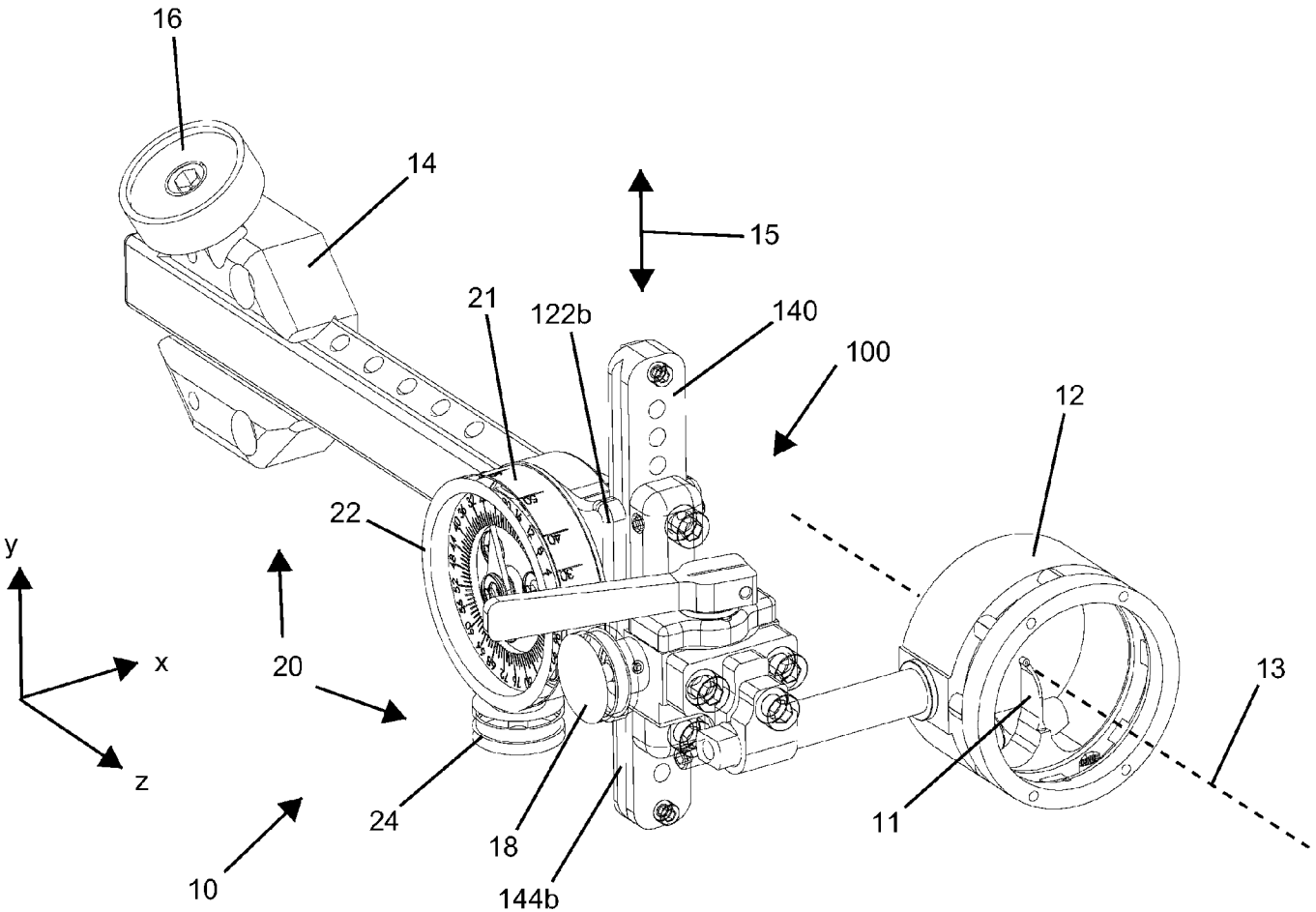
FIG. 1 is a front right perspective view of an exemplary archery sight assembly.
Figure 2:
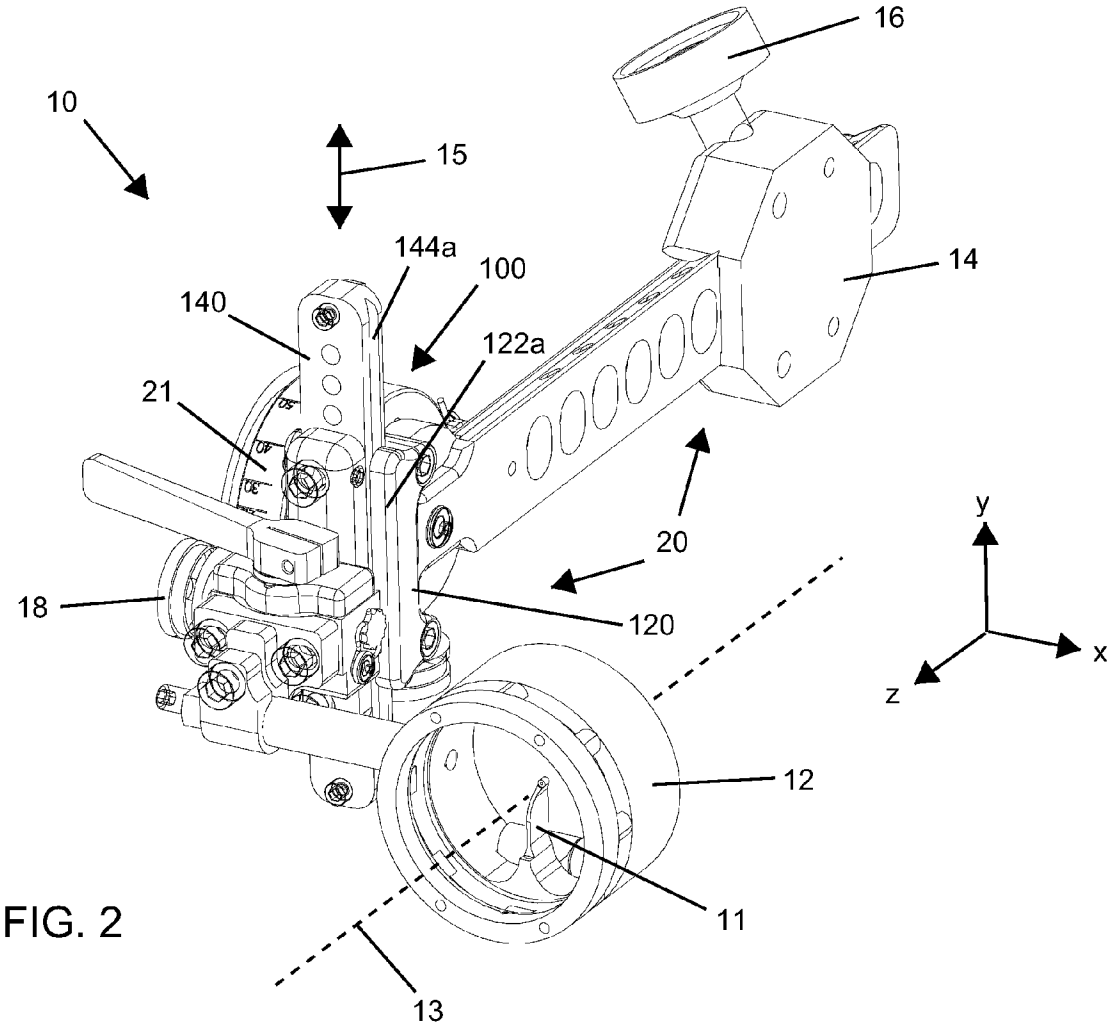
FIG. 2 is a front left perspective view of the exemplary archery sight assembly.

The embodiments shown in the Figures are exemplary, and should not be construed as limiting the scope of the present disclosure or appended claims.

DETAILED DESCRIPTION OF EMBODIMENTS

An archery sight assembly 10 comprises an archery sight 12, a mounting bracket 14, and a positioning mechanism 20 (FIGS. 1-10). The archery sight 12 defines a longitudinal sighting direction 13 (z-axis in FIGS. 1-10). The mounting bracket 14 is arranged to be substantially rigidly attached to an archery bow 99 (shown in FIGS. 7 and 9), thereby mounting the archery sight 12 on the bow 99. The positioning mechanism 20 couples the archery sight 12 to the mounting bracket 14 and is arranged to provide adjustment of the position or orientation of the archery sight 12 relative to the mounting bracket 14. The positioning mechanism 20 can include any desired components arranged in any suitable way to provide the desired adjustments of the position or orientation of archery sight 12. Some archery sights can provide adjustment along all six degrees of freedom, i.e., linear motion along three translational directions and rotary motion about three rotation axes; other archery sights might only provide a subset of those motions. Most archery sights provide linear motion along two directions substantially transverse to the sighting direction (i.e., along the x- and y-axes in the Figures). In the example shown in FIGS. 1-10, loosening a locking screw with knob 16 enables adjustment parallel to the z-axis by sliding a support member through mounting bracket 14, and the assembly 10 is arranged to provide adjustment parallel to the x-axis using knob 18 and parallel to the y-axis (i.e., along direction 15) using cylindrical member 22 (coarse) or knob 24 (fine). Adjustment along a substantially vertical direction (when the bow is held in a drawn position ready to shoot) can be used to correct for range, and adjustment along a horizontal direction can be used to correct for windage. Those directions can differ in their orientations relative to the bow 99 on which the archery sight 12 is mounted. For a regular bow (as shown in the Figures), the vertical adjustment typically is substantially parallel to the riser of the bow 99 along direction 15. For a crossbow, the vertical adjustment typically is substantially perpendicular to the riser of the bow.

A method for making the archery sight assembly 10 comprises coupling the archery sight 12 to the mounting bracket 14 using the positioning mechanism 20, and can further comprise substantially rigidly attaching the mounting bracket 14 to the archery bow 99. A method for using the archery sight assembly 10 comprises adjusting the position or orientation of the archery sight 10 relative to the mounting bracket 14 using the positioning mechanism 20, and can further comprise substantially rigidly attaching the mounting bracket 14 to the archery bow 99.

Figure 11C:
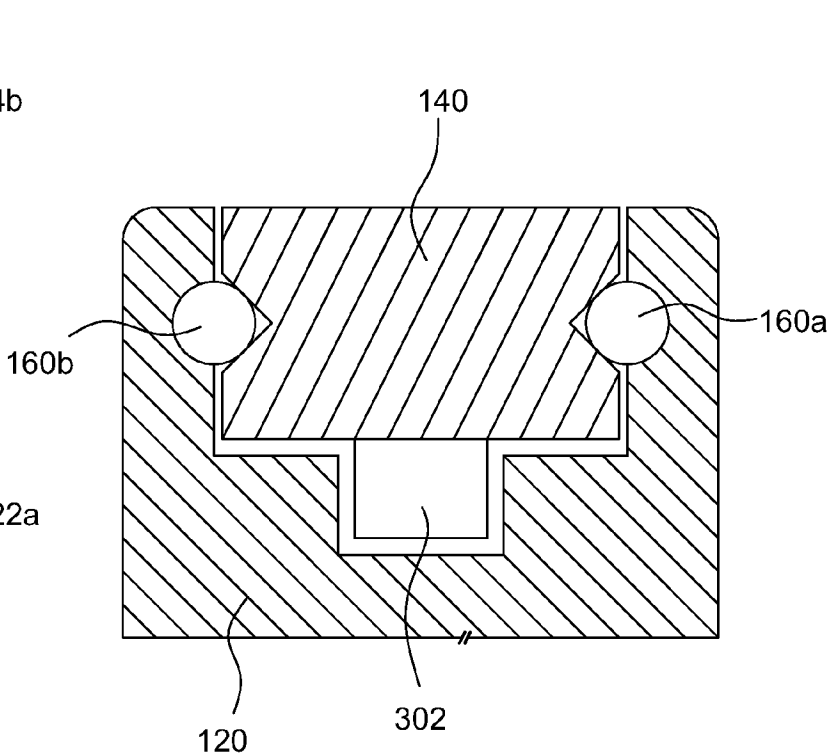
FIGS. 11A-11C are cross-sectional views of a bearing slide, a bearing track, and an assembled linear bearing of the exemplary archery sight assembly.
Figure 11A:
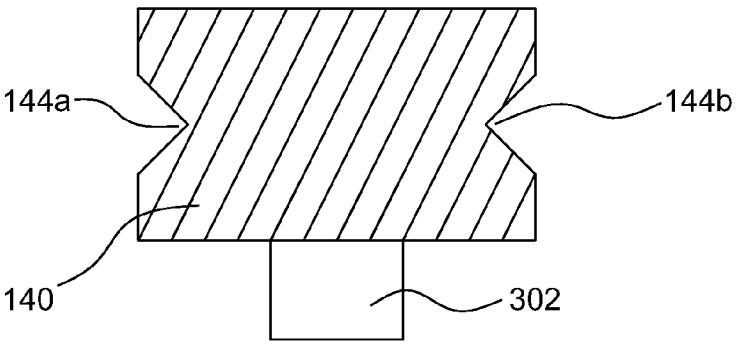
Figure 11B:
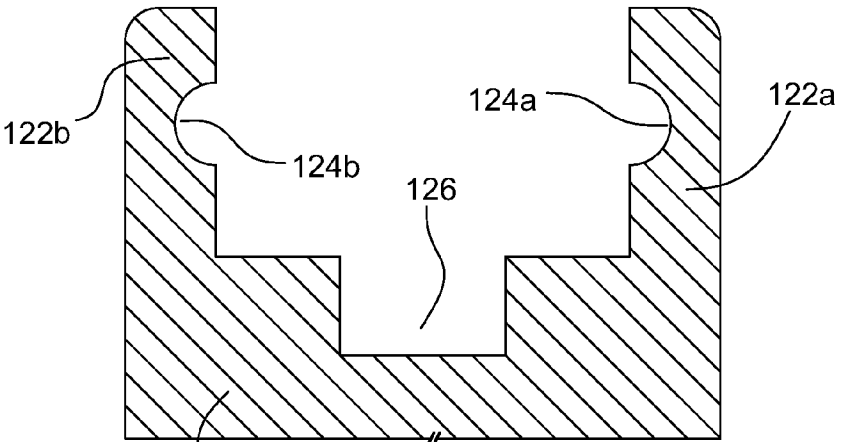

In some embodiments of the archery sight assembly 10, the positioning mechanism 20 includes at least one linear bearing 100 for providing substantially linear motion of the archery sight 12 along a corresponding direction 15 substantially transverse to the sighting direction 13. The linear bearing 100 comprises a bearing track 120, a bearing slide 140, and a pair of cylindrical bearing members 160*a*/160*b*. The bearing track 102 has along at least a portion of its length a U-shaped cross-section (FIG. 11B) transverse to the direction of motion 15 that it defines. In the exemplary assembly 10, the U-shaped cross-section includes a slot 126 for accommodating a rack 302 formed on the bearing slide 140 (described further below), and is interrupted by a gap (not shown) through which a gear 304 extends to engage the rack 304. Other arrangements can be employed, including ones that do not include slot 126 in the bearing track 120 or rack 302 on the bearing slide 140. Each of two side portions 122*a*/122*b* of the U-shaped cross section of the bearing track 120 has a corresponding groove 124*a*/124*b* on its inner surface arranged substantially parallel to the defined direction of motion 15. The grooves 124*a*/124*b* face one another across the bearing track 120.

The bearing slide 140 (FIG. 11A) is positioned between the side portions 122*a*/122*b* of the bearing track 120 (FIG. 11C) and is reciprocally moveable within the bearing track along the defined direction of motion 15 (along the y-axis in the Figures). The bearing slide 140 has a groove 144*a*/144*b* on each of two opposite sides, with each groove 144*a*/144*b* arranged substantially parallel to the defined direction of motion 15 and facing a corresponding one of the grooves 124*a*/124*b*. The cylindrical bearing members 160*a*/160*b* are positioned with their corresponding cylinder axes substantially parallel to the defined direction of motion 15. Each cylindrical bearing member 160*a*/160*b* is engaged with corresponding facing bearing track grooves 124*a*/124*b* and bearing slide grooves 144*a*/144*b*, i.e., cylindrical bearing 160*a* is engaged with facing grooves 124*a* and 144*a*, and cylindrical bearing 160*b* is engaged with facing grooves 124*b* and 144*b*. Generally, each cylindrical bearing 160*a*/160*b* can be arranged to slide along one or both of the corresponding engaged grooves 124*a*/124*b*/144*a*/144*b* as the bearing slide 140 moves along the defined direction within the bearing track 120.

In one example, the linear bearing 100 can be arranged so that each cylindrical bearing 160*a*/160*b* can move along both of its corresponding engaged grooves 124*a*/124*b*/144*a*/144*b*, i.e., cylindrical bearing 160*a* can slide along both of the grooves 124*a* and 144*a* and cylindrical bearing 160*b* can slide along both of the grooves 124*b* and 144*b*. The range of motion of each cylindrical bearing member 160*a*/160*b* need not be the same along both of its corresponding engaged grooves 124*a*/124*b*/144*a*/144*b*. Alternatively, each cylindrical bearing 160*a*/160*b* can be constrained to slide along only one of the corresponding engaged grooves, i.e., cylindrical bearing 160*a* can slide along only one of the grooves 124*a* or 144*a* and cylindrical bearing 160*b* can slide along only one of the grooves 124*b* or 144*b*.

In the exemplary assembly 10, the bearing track grooves 124*a*/124*b* are arranged to receive the corresponding cylindrical bearing members 160*a*/160*b* in a snap-fit or press-fit arrangement, and the bearing track grooves 144*a*/144*b* are arranged as v-grooves. The cylindrical bearing members 160*a*/160*b* are therefore constrained to slide only along v-grooves 144*a*/144*b*. Other arrangements or groove types can be employed In the exemplary assembly 10 the bearing slide 140 is shown as being longer than bearing track 120 so that end portions of the bearing slide 140 extend beyond the ends of bearing track 120. In alternative arrangements (not shown) the bearing track 120 and the bearing slide 140 can be substantially equal in length, or bearing track 120 can be longer than bearing slide 140.

The bearing track 120 can be arranged to apply an adjustable level of compression to the cylindrical bearing members 160*a*/160*b* between the corresponding engaged grooves 124*a*/124*b*/144*a*/144*b*. In the example shown, the linear bearing 100 includes one or more adjustment screws 110 that are arranged to urge the side portions 122*a*/122*b* toward one another, compressing the cylindrical bearings 160*a*/160*b* against the grooves 144*a*/144*b* of the bearing slide 140. Such adjustment can be employed to ensure that the linear bearing 100 enables motion along the defined direction 15 but does not enable an unacceptable degree of motion along or about other directions or axes. For example, excessive compression can prevent the desired motion along the defined direction, or can cause that motion to require too much force to be applied (i.e., to be too "stiff"). Such stiffness would be perceived or assessed differently by different users. Alternatively, insufficient compression of the cylindrical bearing members 160*a*/160*b* can allow an unacceptable range of translational motion of the bearing slide 140 in directions transverse to the defined direction 15 (i.e., along the x- or z-axis in the Figures), or can allow the bearing track 140 to pitch, roll, or yaw. Such insufficient compression can arise over time due to wear of the cylindrical bearing members 160*a*/160 or the grooves 124*a*/124*b*/144*a*/144*b*. Adjustment of the level of compression of the cylindrical bearing members 160*a*/160*b* between the facing grooves 124*a*/124*b*/144*a*/144*b* enables a user to set a desired level of "stiffness" to the motion along the defined direction 15, or to readjust the compression to compensate for later wear.

Figure 3:
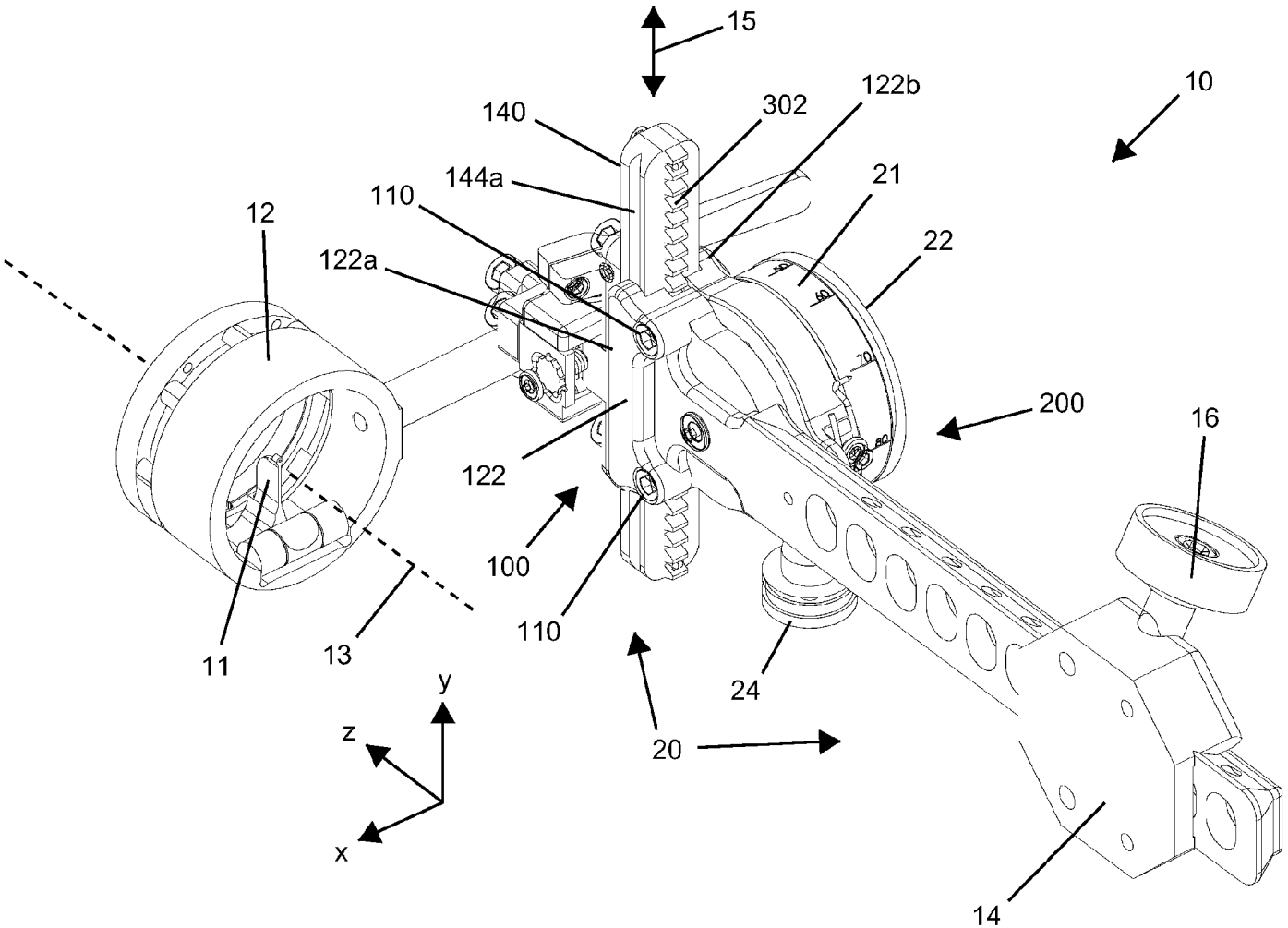
FIG. 3 is a rear left perspective view of the exemplary archery sight assembly.
Figure 4:
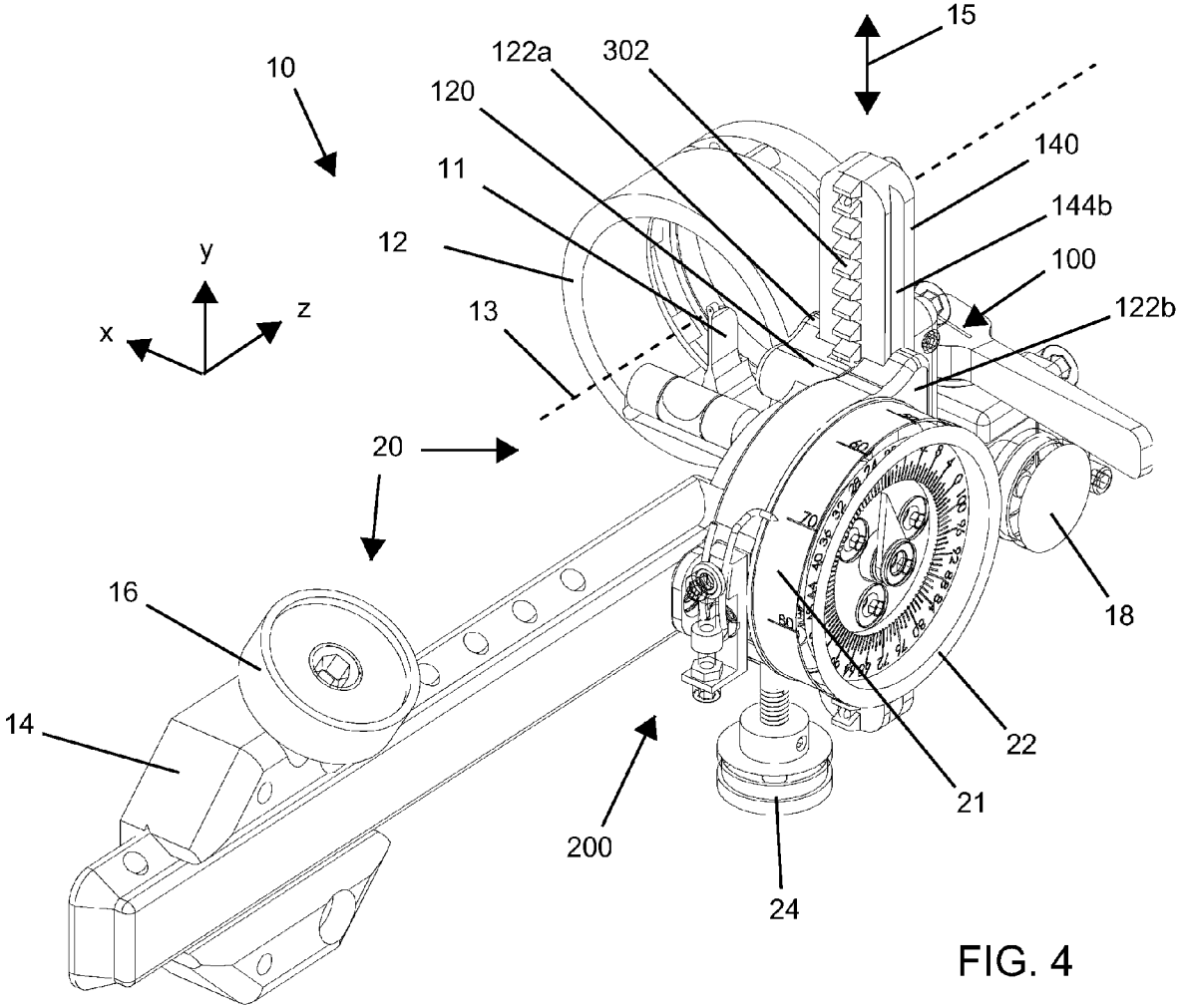
FIG. 4 is a rear right perspective view of the exemplary archery sight assembly.
Figure 5:
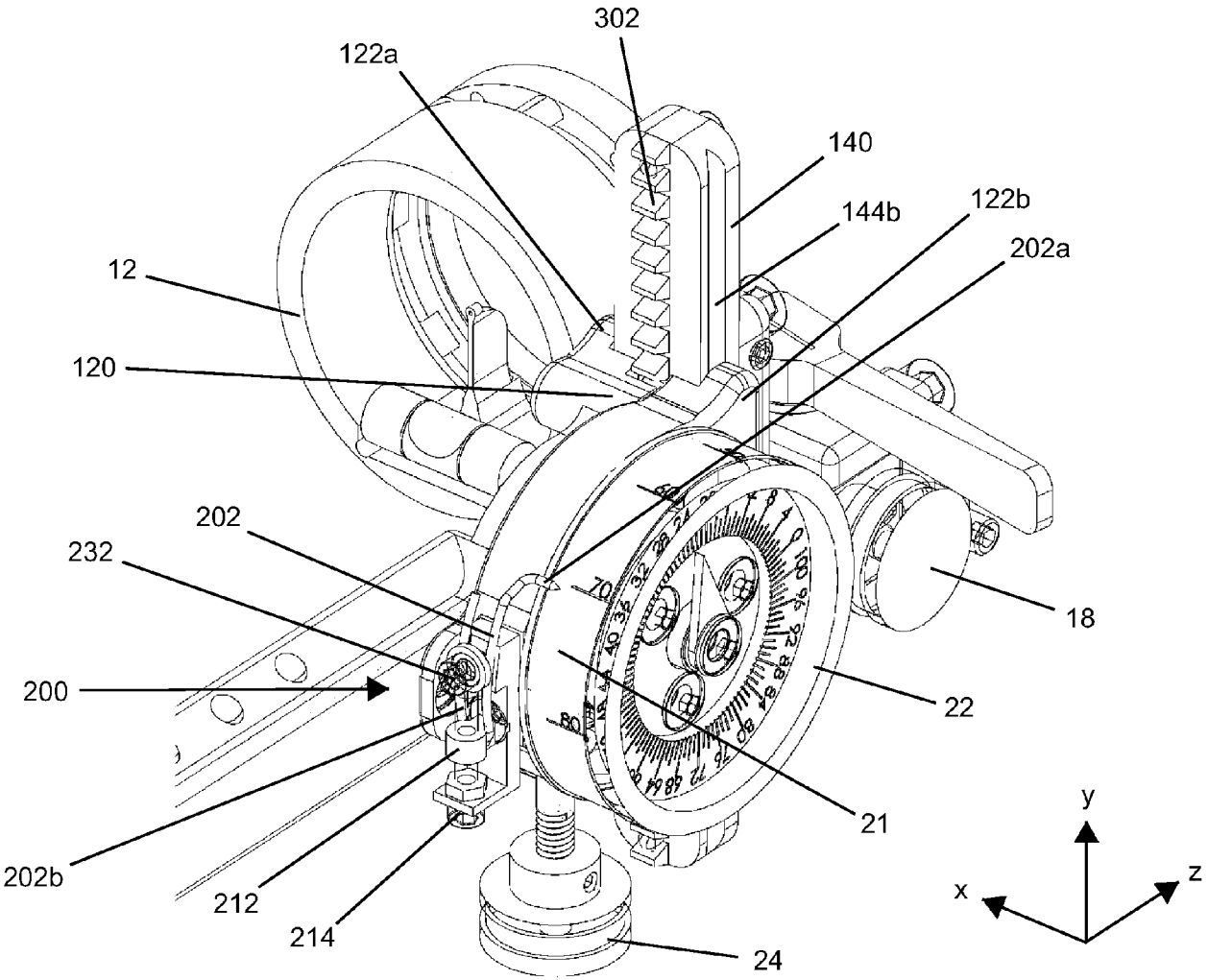
FIG. 5 is an enlarged right perspective view of a portion of the exemplary archery sight assembly.
Figure 6:
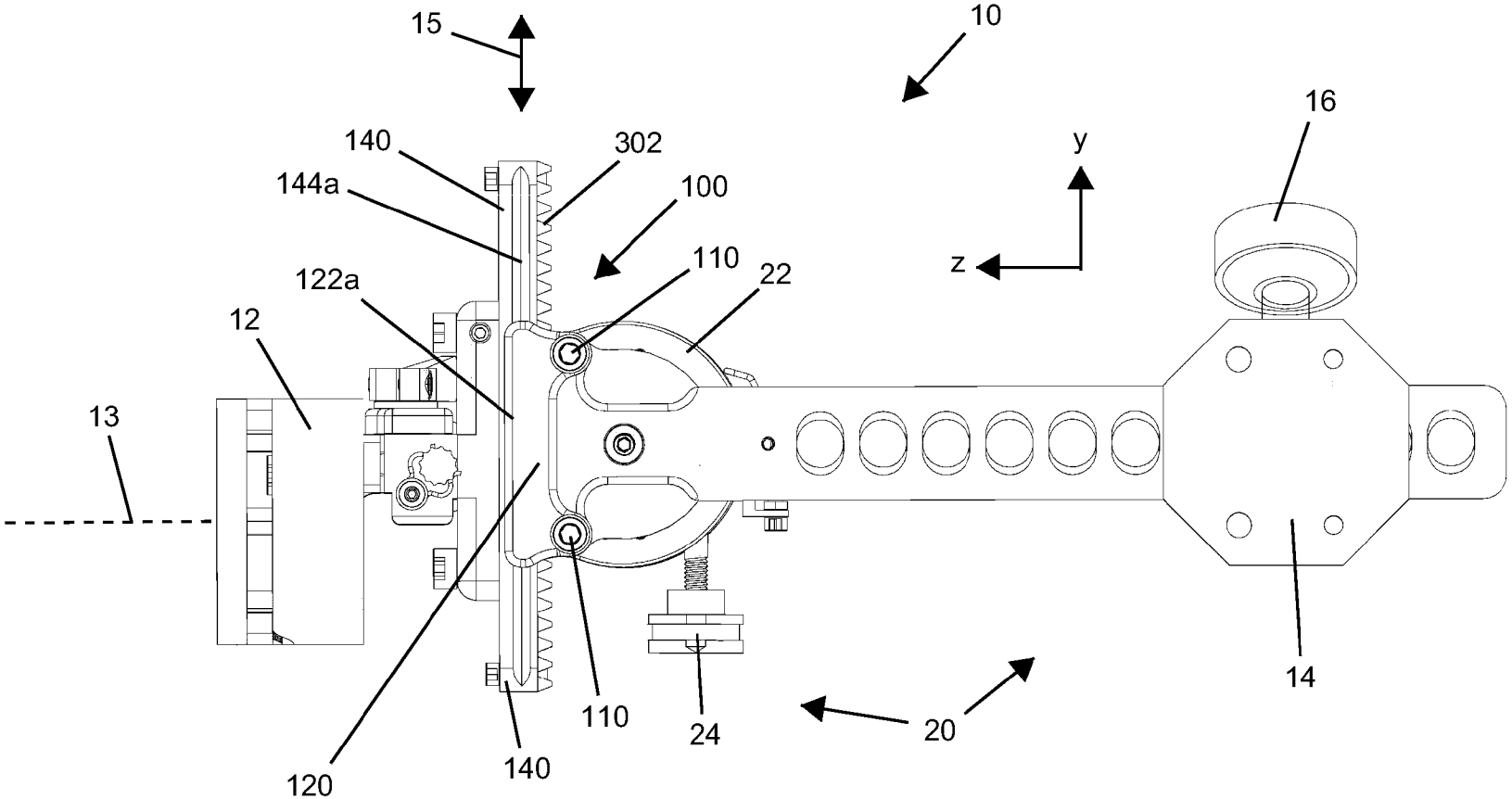
FIG. 6 is a left side view of the exemplary archery sight assembly.
Figure 7:
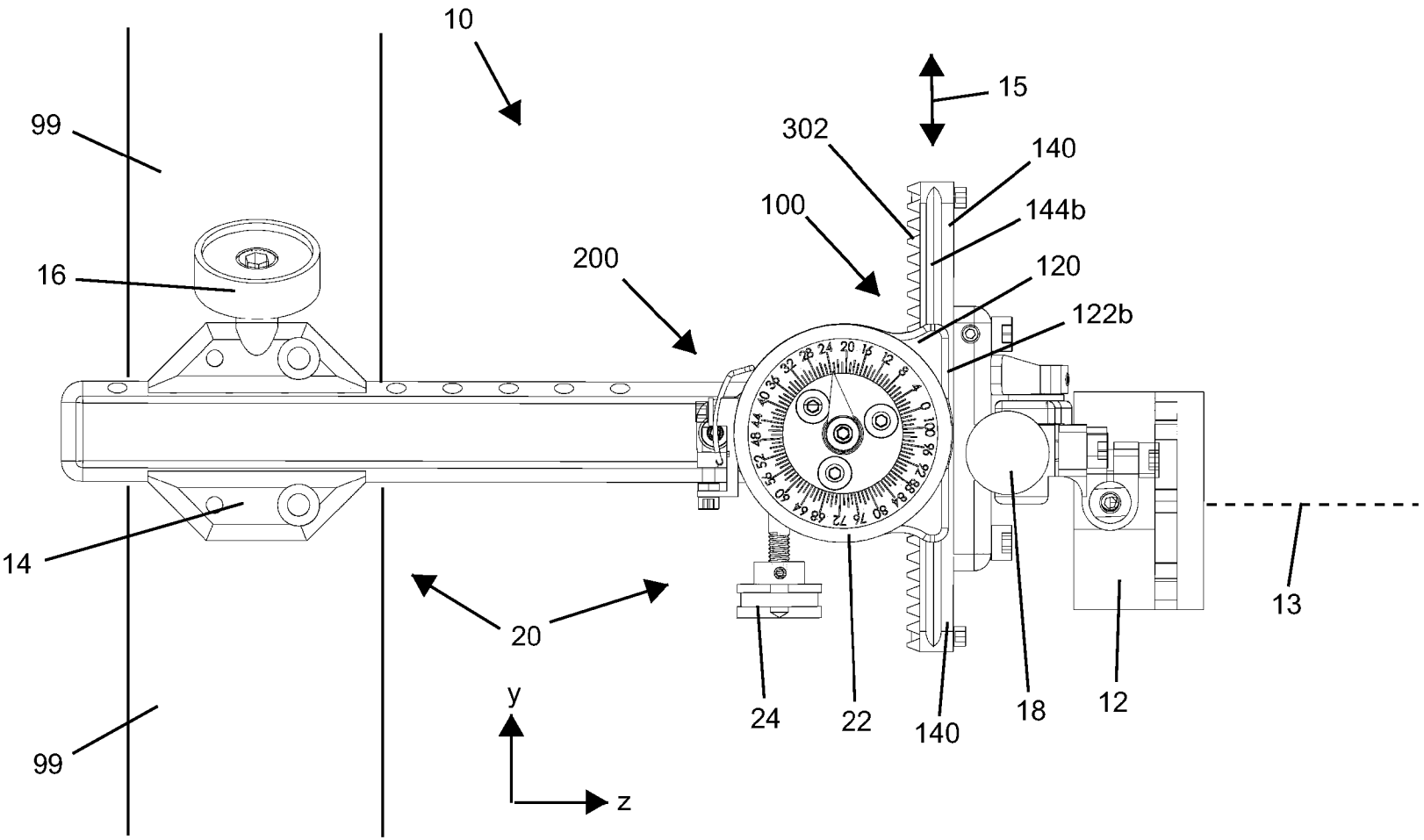
FIG. 7 is a right side view of the exemplary archery sight assembly mounted on a bow.
Figure 8:
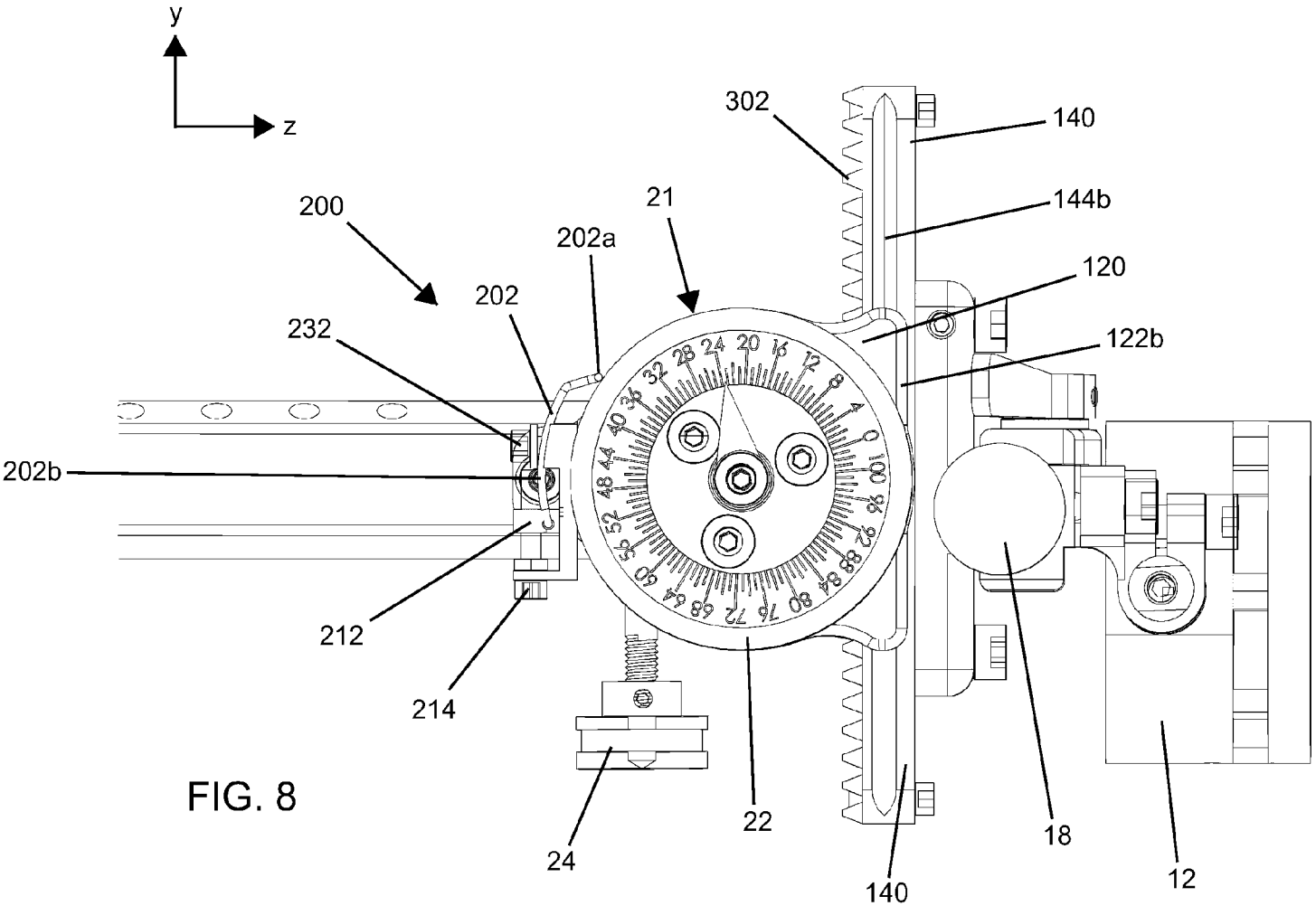
FIG. 8 is an enlarged right side view of a portion of the exemplary archery sight assembly.
Figure 9:
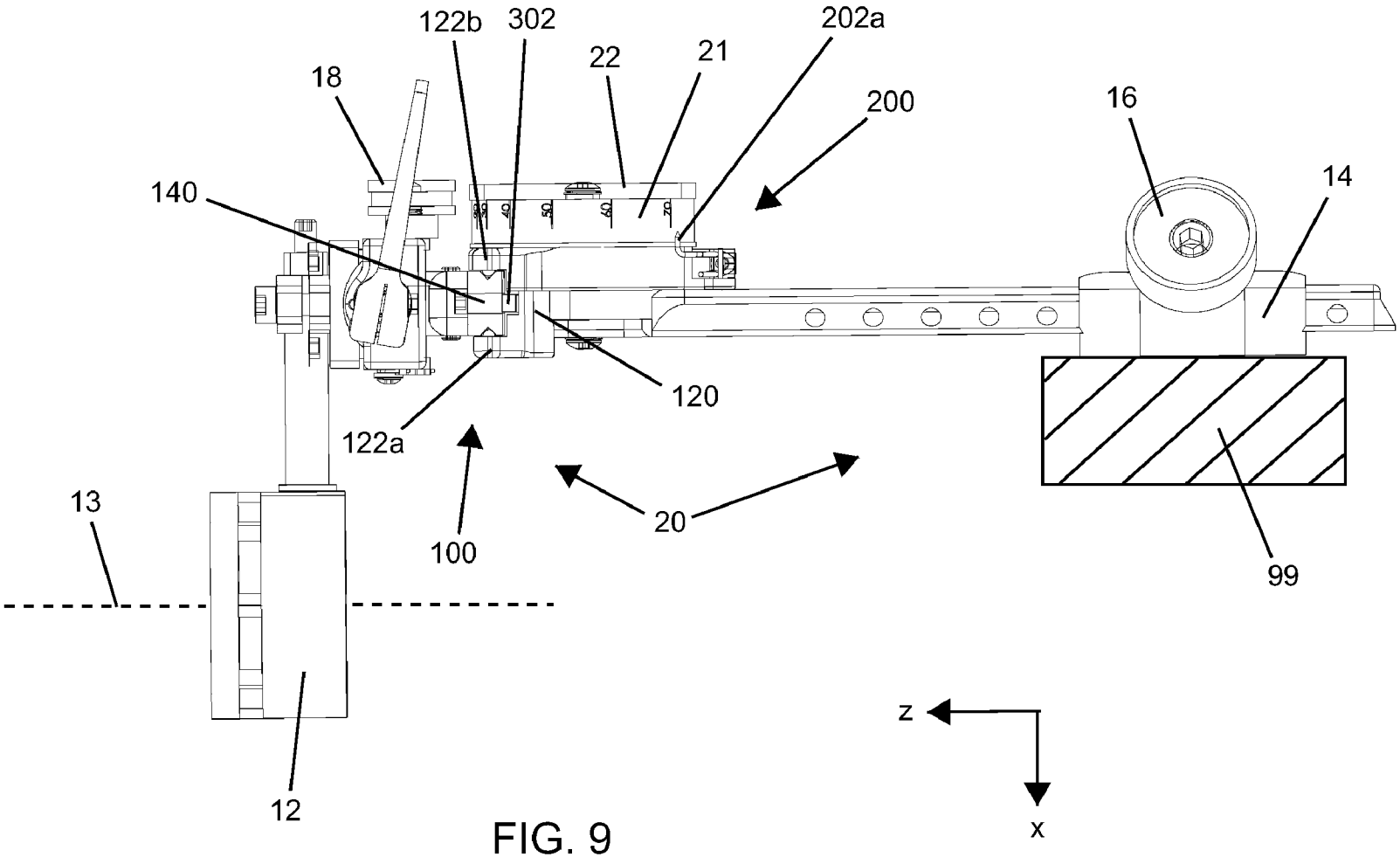
FIG. 9 is a top view of the exemplary archery sight assembly mounted on a bow.
Figure 10:
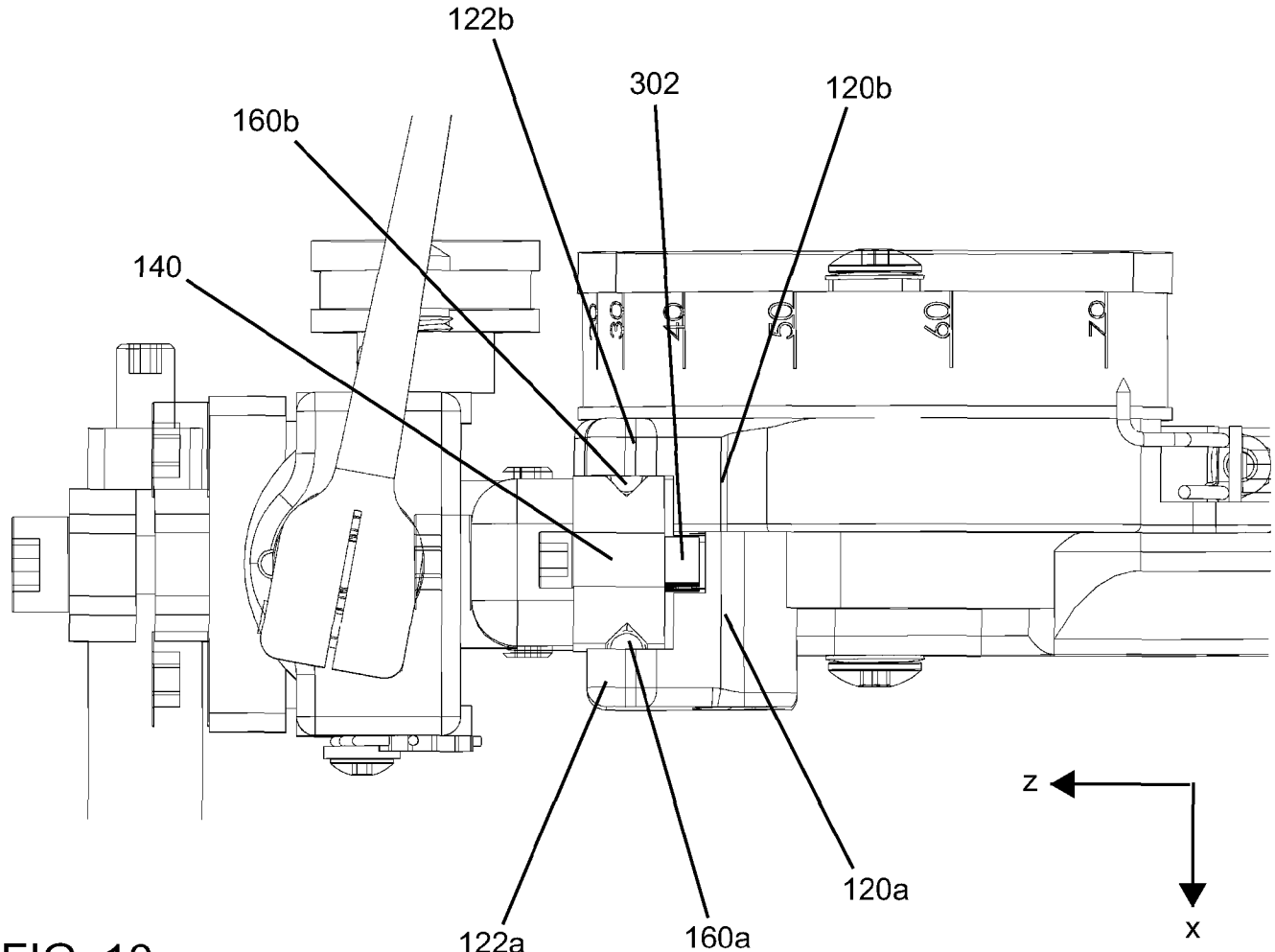
FIG. 10 is an enlarged top view of a portion of the exemplary archery sight assembly.

The bearing track 120 or bearing slide 140 can be arranged or adapted in any suitable way to provide the adjustable compression of the cylindrical bearing members 160*a*/160*b*. In one example, the side portions 122*a*/122*b* of the bearing track 120 can be sufficiently deformable (plastic or elastic) so as to permit the adjustment screws 110 (or other suitable adjustment actuator; FIGS. 3 and 6) to move the side portions 122*a*/122*b* of the bearing track 120 toward one another. In another example (shown in FIGS. 1-10), the bearing track 120 can comprise discrete longitudinal portions 120*a*/120*b* (FIG. 10), each including a corresponding one of the side portions 122*a*/122*b*. The adjustment screws 110 (or other suitable adjustment actuator) are arranged to urge the bearing track longitudinal portions 120*a*/120*b* (along with the side portions 122*a*/122*b*) toward one another. Methods for making or using the archery sight assembly 10 can include adjusting the compression of the cylindrical bearing members 160*a*/160*b* between the facing grooves 124*a*/124*b*/144*a*/144*b*.

The bearing track 120, the bearing slide 140, and the cylindrical bearing members 160*a*/160*b* can be made of any suitable material or combination of materials. In one example, bearing track 120 and bearing slide 140 are made of aluminum and the cylindrical bearing members 160*a*/160*b* are made of stainless steel. Any other suitable metal, alloy, or polymer materials, friction materials, or combinations thereof, can be employed as needed or desired.

In other embodiments of the archery sight assembly 10, the positioning mechanism 20 includes (i) a scale 21 arranged to indicate motion along or about a corresponding direction or axis of motion and (ii) a pointer 200 arranged so that the scale 21 moves relative to the pointer 200 during the indicated motion. The pointer 200 includes an adjustment mechanism that enables it to be repositioned relative to the scale 21, and includes a locking mechanism that enables it to be released and repositioned by the adjustment mechanism and to be retained at a desired position relative to the scale 21.

In the exemplary assembly 10, the indicated motion is linear motion along the direction 15 (along the y-axis in the Figures), and the positioning mechanism 20 includes a cylindrical member 22 arranged to rotate about its axis in synchrony with the indicated linear motion along direction 15. The scale 21 is disposed around an outer circumference of the cylindrical member 22. Scale 21 can be arranged in any other suitable way on the positioning mechanism 20, e.g., a linear scale and pointer can be positioned on linear bearing 100. In the exemplary assembly 10 the pointer 200 is coupled to the positioning mechanism 20 so that the adjustment mechanism moves the pointer along an arc-shaped path substantially concentric with the cylindrical member 22. A portion 202*b* of the pointer is curved in the form of an arc that is substantially concentric with the cylindrical member 22.

In the exemplary assembly 10, the pointer 200 comprises a wire 202, a threaded block 212, an adjustment screw 214, and a locking screw 232. The wire 202 is bent to form (i) a first wire segment 202*a* substantially parallel to an axis of the cylindrical member 22 and positioned at its outer circumference over the scale 21, and (ii) a pair of parallel, spaced-apart wire segments 202*b* curved in the form of an arc that is substantially concentric with the cylindrical member 22. The threaded block 212 is mounted on or between the pair of wire segments 202*b*. The adjustment screw 214 is threadedly engaged with the threaded block 212 and rotatably engaged with the positioning mechanism 20 so that turning the adjustment screw 214 moves the wire 202 along an arc-shaped path defined by the pair of curved wire segments 202*b*. The adjustment mechanism in this example therefore comprises the threaded block 212 and the adjustment screw 214. Any other suitable adjustment mechanism can be employed. The locking screw 232 passes between the pair of curved wire segments 202*b* and is threadedly engaged with the positioning mechanism 20 so that tightening the locking screw 232 locks the pair of curved wire segments 202*b* against the positioning mechanism 20. The locking mechanism therefore comprises locking screw 232. Any other suitable locking mechanism can be employed.

Figure 12:
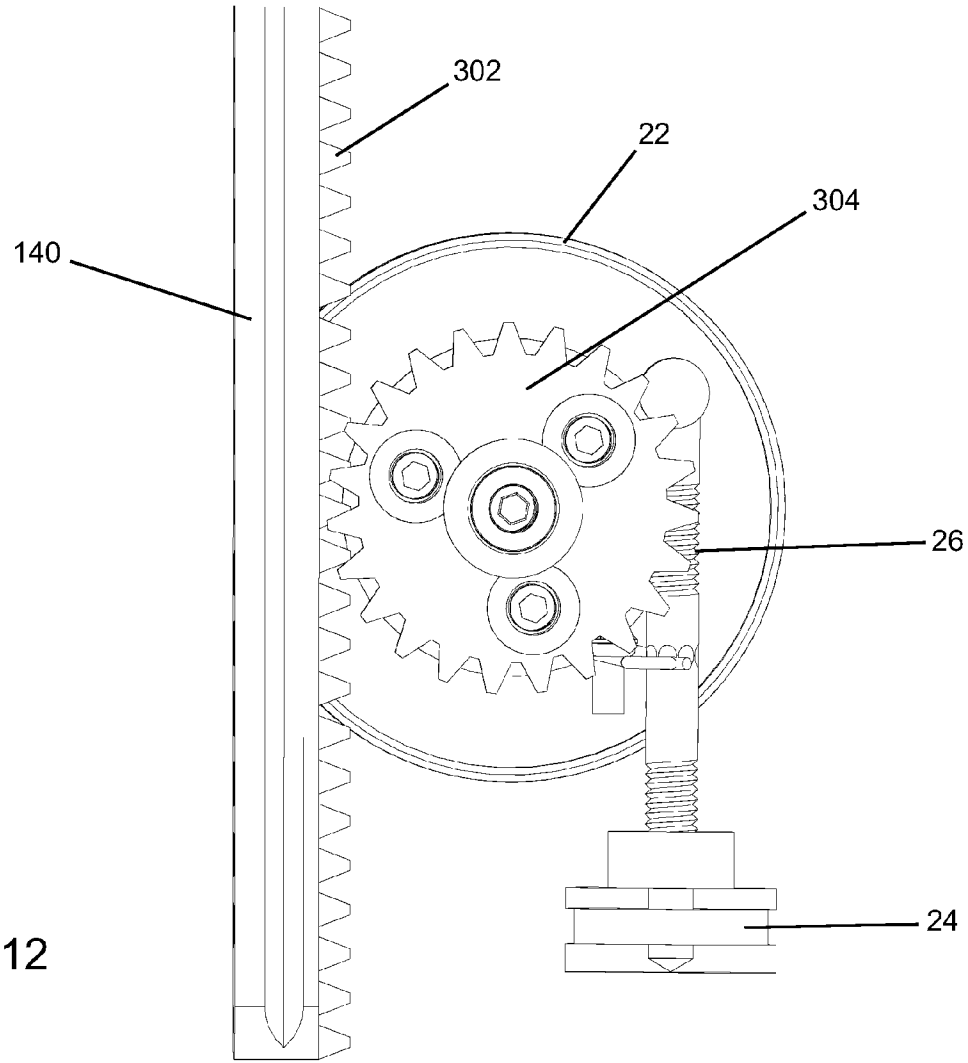
FIG. 12 is a left side view of a knob, gear, and rack of the exemplary archery sight assembly.

In the exemplary assembly 10, the cylindrical member 22 is substantially rigidly connected to a substantially coaxial gear 304 and the gear 304 is arranged to couple motion of an adjustment knob to the indicated motion 15 of the positioning mechanism 20 by engaging rack 302 on bearing slide 140. In this example (shown in FIG. 12), a fine-adjustment knob 24 can be arranged to rotate cylindrical member 22 and gear 304 (in this example employing a worm drive 26), which in turn drives rack 302. Alternatively, cylindrical member 22 can act as the knob when the fine-adjustment knob 24 is disengaged from cylindrical member 22 and gear 304 (e.g., by disengaging the worm drive 26).

Methods for making or using the archery sight assembly 10 can include disengaging the locking mechanism to release the pointer 200, repositioning the pointer 200 with the adjustment mechanism to a desired position relative to the scale 21, and engaging the locking mechanism to retain the pointer 200 at the desired position. Such methods can be employed, for example, when the bow 99 and the archery sight 12 have been aligned so that a known distance corresponds to a reference marker in the sight 12 (e.g., pin 11, cross-hairs, or a reticle). The pointer 200 can then be repositioned so that a chosen mark on the scale 21 corresponds to the known distance (making future adjustment of the sight 12 to that distance more accurately repeatable), or so that a different distance can be selected by adjusting the position of sight 12 to match a different selected mark on scale 21.

In other embodiments of the archery sight assembly 10, the positioning mechanism comprises a rack 302 (formed on the bearing slide 140 in the exemplary assembly 10), an adjustment knob, and one or more gears that couple the rack 302 to the adjustment knob. In the example of FIGS. 1-10 and 12, with the fine-adjustment knob 24 disengaged, cylindrical member 22 acts as the adjustment knob, and the coaxial gear 304 couples the cylindrical member 22 to the rack 304 (through a gap in the bearing track 120; not shown). With fine-adjustment knob 24 engaged with the cylindrical member 22 (by means of worm drive 26 shown in FIG. 12), knob 24 acts as the adjustment knob that is coupled to rack 302 by the worm drive 26 and gear 304.

Figure 13:
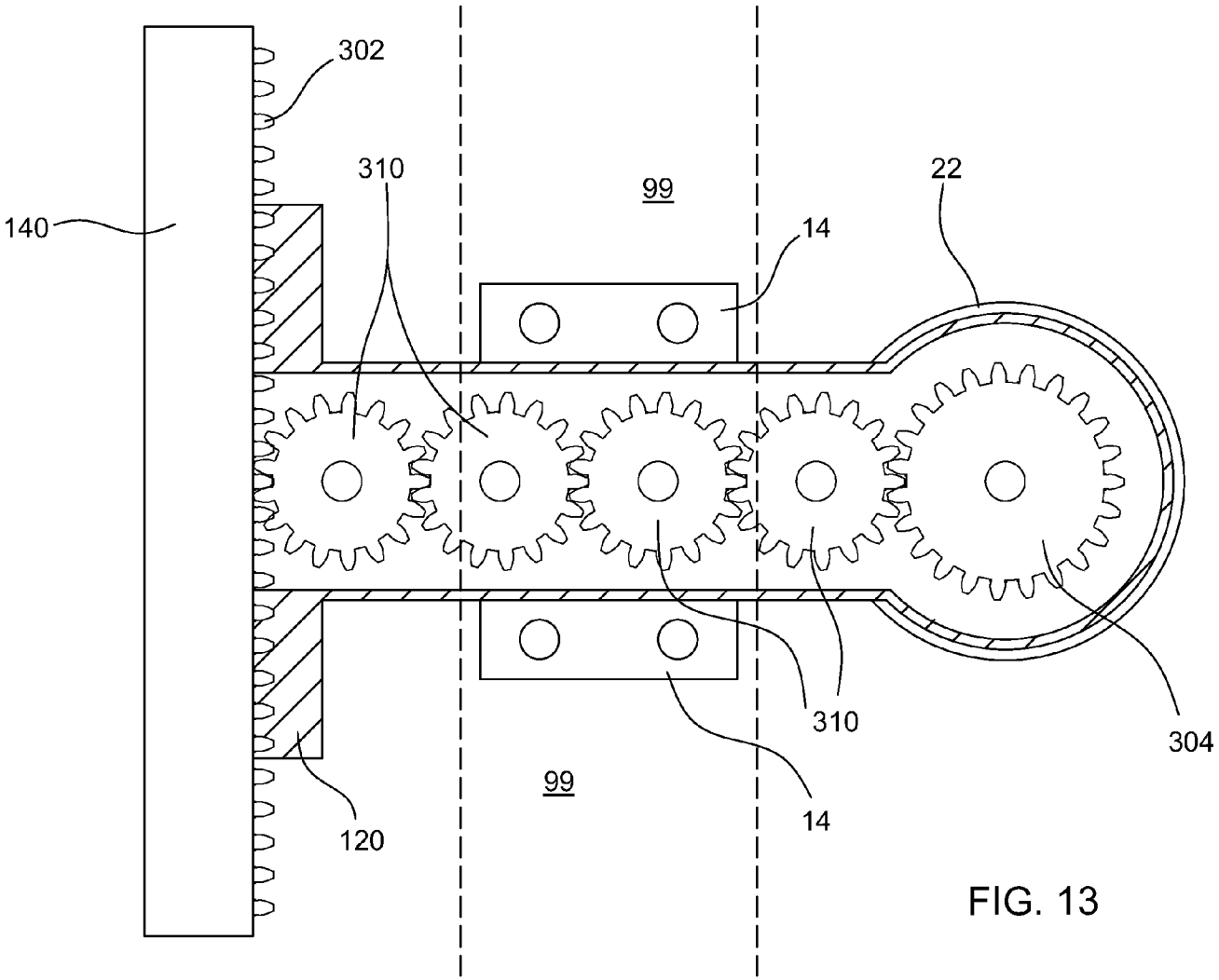
FIG. 13 is a left side view of a knob, gear set, and rack of another exemplary archery sight assembly mounted on a bow.

In the exemplary embodiment of FIG. 13, one or more additional gears 310 couple coaxial gear 304 to rack 302. As in the previous example, a fine-adjustment knob 24 or cylindrical member 22 can act as the adjustment knob, depending on whether fine-adjustment knob 24 is engaged to rotate cylindrical member 22. With either adjustment knob (cylindrical member 22 or knob 24), the gears 304 and 310 couple the adjustment knob to the rack 302. The adjustment knob, gears 304 and 310, and the rack 302 can be arranged so that the portion of the mounting bracket 14 that is arranged to be attached to the archery bow 99 is positioned between the rack 302 and the adjustment knob. In that case, once the archery sight assembly 10 is attached to the archery bow 99 (via mounting bracket 14; bow 99 indicated by dashed lines in FIG. 13), the rack 302 is positioned forward of the riser of the bow 99 and the adjustment knob is positioned rearward of the riser. This can be advantageous, for example, in that it enables an archer to see the position setting of the archery sight assembly 10 (e.g., the relative positions of scale 21 and pointer 200) while the archer holds the bow at full draw. A conventional archery sight positioning mechanism (based on a lead screw coupled via a mating nut on bearing slide 140) typically has a vertical adjustment knob located below the bearing side 140 in front of the riser, where it is difficult for the archer to see.

In addition to (or instead of) being arranged to position the knob behind the riser, the gears 304 and 310 can be arranged as a set of reduction gears to reduce the linear motion of the rack 302 relative to rotation of the adjustment knob. Such an arrangement enables more precise adjustment of the position of the archery sight 12. Any desired degree of gear reduction can be employed; in the example of FIG. 13, a reduction ratio is determined by gear 304 and the gear 310 that is engaged with gear 304. An analogous adaptation cannot be implemented conveniently for a conventional archery sight assembly that incorporates a lead screw.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or", "only one of . . . ", or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof shall be construed as open ended terminology, with the same meaning as if the phrase "at least" were appended after each instance thereof.

In the appended claims, if the provisions of 35 USC §112 ¶ 6 are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112 ¶ 6 are not intended to be invoked for that claim.

What is claimed is:

1. An archery sight assembly comprising:

an archery sight defining a longitudinal sighting direction;

a mounting bracket arranged to be substantially rigidly attached to an archery bow; and a positioning mechanism coupling the archery sight to the mounting bracket and arranged to provide adjustment of the position or orientation of the archery sight relative to the mounting bracket, which positioning mechanism includes at least one linear bearing for providing substantially linear motion of the archery sight along a corresponding direction substantially transverse to the sighting direction, wherein the linear bearing comprises:

a bearing track having along at least a portion of its length a U-shaped cross-section transverse to a direction of motion defined by the linear bearing, each of two side portions of the U-shaped cross section of the bearing track having a corresponding groove on its inner surface arranged substantially parallel to the defined direction of motion, the grooves of the corresponding side portions facing one another across the bearing track;

a bearing slide positioned between the side portions of the bearing track and reciprocally moveable within the bearing track along the defined direction of motion, the bearing slide having a groove on each of two opposite sides, each bearing slide groove arranged substantially parallel to the defined direction of motion and facing a corresponding one of the bearing track grooves; and a pair of cylindrical bearing members, each cylindrical bearing member being positioned with its corresponding cylinder axis substantially parallel to the defined direction of motion and engaged with corresponding facing bearing track grooves and bearing slide grooves, each cylindrical bearing being arranged to slide along at least one of the corresponding engaged grooves as the bearing slide moves along the defined direction within the bearing track, wherein the bearing track comprises discrete longitudinal portions that each correspond to one of the side portions, and that are arranged to be urged toward one another so as to apply an adjustable level of compression to the cylindrical bearing members with the corresponding engaged grooves, and to thereby permit movement of the bearing slide within the bearing track with a desired level of stiffness.

2. The assembly of claim 1 wherein the linear bearing includes one or more adjustment screws arranged to urge the side portions of the bearing track toward one another.

3. The assembly of claim 1 wherein each cylindrical bearing is constrained to slide along only one of the corresponding engaged grooves.

4. The assembly of claim 3 wherein each cylindrical bearing is snap-fit or press-fit into the corresponding groove on the corresponding side portion of the bearing track, each bearing slide groove comprises a v-groove, and each cylindrical bearing is constrained to slide along the corresponding engaged groove on only the bearing slide.

5. The assembly of claim 1 wherein the bearing track grooves or the bearing slide grooves comprise v-grooves.

6. The apparatus of claim 1 further comprising an archery bow, wherein the mounting bracket is substantially rigidly attached to the bow thereby mounting the archery sight on the bow.

7. The archery bow of claim 6 wherein the archery sight assembly is arranged so that the defined direction of motion is substantially vertical with the bow held in a drawn position.

8. The method of claim 1 further comprising adjusting the compression of the cylindrical bearing members.

9. A method for making an archery sight assembly, the method comprising coupling an archery sight to a mounting bracket using a positioning mechanism that is arranged to provide adjustment of the position or orientation of the archery sight relative to the mounting bracket, wherein the mounting bracket is arranged to be substantially rigidly attached to an archery bow;

wherein the archery sight defines a longitudinal sighting direction;

wherein the positioning mechanism includes at least one linear bearing for providing substantially linear motion of the archery sight along a corresponding direction substantially transverse to the sighting direction;

wherein the linear bearing comprises:

a bearing track having along at least a portion of its length a U-shaped cross-section transverse to a direction of motion defined by the linear bearing, each of two side portions of the U-shaped cross section of the bearing track having a corresponding groove on its inner surface arranged substantially parallel to the defined direction of motion, the grooves of the corresponding side portions facing one another across the bearing track;

a bearing slide positioned between the side portions of the bearing track and reciprocally moveable within the bearing track along the defined direction of motion, the bearing slide having a groove on each of two opposite sides, each bearing slide groove arranged substantially parallel to the defined direction of motion and facing a corresponding one of the bearing track grooves; and a pair of cylindrical bearing members, each cylindrical bearing member being positioned with its corresponding cylinder axis substantially parallel to the defined direction of motion and engaged with corresponding facing bearing track grooves and bearing slide grooves, each cylindrical bearing being arranged to slide along at least one of the corresponding engaged grooves as the bearing slide moves along the defined direction within the bearing track; and wherein the bearing track comprises discrete longitudinal portions that each correspond to one of the side portions, and that are arranged to be urged toward one another so as to apply an adjustable level of compression to the cylindrical bearing members with the corresponding engaged grooves, and to thereby permit movement of the bearing slide within the bearing track with a desired level of stiffness.

10. The method of claim 9 wherein the linear bearing includes one or more adjustment screws arranged to urge the side portions of the bearing track toward one another.

11. The method of claim 9 wherein each cylindrical bearing is constrained to slide along only one of the corresponding engaged grooves.

12. The method of claim 11 wherein each cylindrical bearing is snap-fit or press-fit into the corresponding groove on the corresponding side portion of the bearing track, each bearing slide groove comprises a v-groove, and each cylindrical bearing is constrained to slide along the corresponding engaged groove on only the bearing slide.

13. The method of claim 9 wherein the bearing track grooves or the bearing slide grooves comprise v-grooves.

14. The method of claim 9 further comprising substantially rigidly attaching the mounting bracket to an archery bow.

15. The method of claim 14 wherein the archery sight assembly is arranged so that the defined direction of motion is substantially vertical with the bow held in a drawn position.

16. A method for using an archery sight assembly, the method comprising adjusting position or orientation of an archery sight relative to a mounting bracket using a positioning mechanism that couples the archery sight to the mounting bracket, wherein the mounting bracket is arranged to be substantially rigidly attached to an archery bow;

wherein the archery sight defines a longitudinal sighting direction;

wherein the positioning mechanism includes at least one linear bearing for providing substantially linear motion of the archery sight along a corresponding direction substantially transverse to the sighting direction;

wherein the linear bearing comprises:

a bearing track having along at least a portion of its length a U-shaped cross-section transverse to a direction of motion defined by the linear bearing, each of two side portions of the U-shaped cross section of the bearing track having a corresponding groove on its inner surface arranged substantially parallel to the defined direction of motion, the grooves of the corresponding side portions facing one another across the bearing track;

a bearing slide positioned between the side portions of the bearing track and reciprocally moveable within the bearing track along the defined direction of motion, the bearing slide having a groove on each of two opposite sides, each bearing slide groove arranged substantially parallel to the defined direction of motion and facing a corresponding one of the bearing track grooves; and a pair of cylindrical bearing members, each cylindrical bearing member being positioned with its corresponding cylinder axis substantially parallel to the defined direction of motion and engaged with corresponding facing bearing track grooves and bearing slide grooves, each cylindrical bearing being arranged to slide along at least one of the corresponding engaged grooves as the bearing slide moves along the defined direction within the bearing track; and wherein the bearing track comprises discrete longitudinal portions that each correspond to one of the side portions, and that are arranged to be urged toward one another so as to apply an adjustable level of compression to the cylindrical bearing members with the corresponding engaged grooves, and to thereby permit movement of the bearing slide within the bearing track with a desired level of stiffness.

17. The method of claim 16 wherein the linear bearing includes one or more adjustment screws arranged to urge the side portions of the bearing track toward one another.

18. The method of claim 16 further comprising adjusting the compression of the cylindrical bearing members.

19. The method of claim 16 wherein each cylindrical bearing is constrained to slide along only one of the corresponding engaged grooves.

20. The method of claim 19 wherein each cylindrical bearing is snap-fit or press-fit into the corresponding groove on the corresponding side portion of the bearing track, each bearing slide groove comprises a v-groove, and each cylindrical bearing is constrained to slide along the corresponding engaged groove on only the bearing slide.

21. The method of claim 16 wherein the bearing track grooves or the bearing slide grooves comprise v-grooves.

22. The method of claim 16 wherein the archery sight assembly is arranged on the bow so that the defined direction of motion is substantially vertical with the bow held in a drawn position.

23. The method of claim 16 further comprising substantially rigidly attaching the mounting bracket to an archery bow.

* * * * *